US010089846B2

(12) United States Patent
Purcell

(10) Patent No.: US 10,089,846 B2
(45) Date of Patent: Oct. 2, 2018

(54) MONITORING DEVICE

(71) Applicant: CHILD ANGEL LTD, Newcastle-under-Lyme, Staffordshire (GB)

(72) Inventor: Andrew Purcell, Newcastle Staffordshire (GB)

(73) Assignee: CHILD ANDGEL LTD, Newcastle-Under-Lyme, Staffordshire (GB)

( * ) Notice: Subject to any disclaimer, the term of this patent is extended or adjusted under 35 U.S.C. 154(b) by 0 days.

(21) Appl. No.: 15/535,881

(22) PCT Filed: Dec. 8, 2015

(86) PCT No.: PCT/GB2015/053758
§ 371 (c)(1),
(2) Date: Jun. 14, 2017

(87) PCT Pub. No.: WO2016/097693
PCT Pub. Date: Jun. 23, 2016

(65) Prior Publication Data

US 2018/0012472 A1 Jan. 11, 2018

(30) Foreign Application Priority Data

Dec. 15, 2014 (GB) ..... 1422240

(51) Int. Cl.
*G08B 1/08* (2006.01)
*G08B 21/02* (2006.01)

(52) U.S. Cl.
CPC ..... *G08B 21/0286* (2013.01); *G08B 21/023* (2013.01); *G08B 21/0247* (2013.01); *G08B 21/0269* (2013.01)

(58) Field of Classification Search
CPC ..... G08B 21/023; G08B 21/0269; G08B 21/0247; G01S 5/0027
(Continued)

(56) References Cited

U.S. PATENT DOCUMENTS 5,497,149 A * 3/1996 Fast ..... G08B 21/22 340/426.19
7,916,071 B2 * 3/2011 Harper ..... G01S 5/0036 342/357.31

(Continued)

FOREIGN PATENT DOCUMENTS

DE 20319858 4/2004
WO WO2004019297 A1 3/2004
WO WO2015125937 A1 8/2015

*Primary Examiner* — John A Tweel, Jr.
(74) *Attorney, Agent, or Firm* — King & Schickli, PLLC

(57) ABSTRACT

A wireless monitoring device, comprising: a housing (10) in which is contained a wireless communication circuit for sending and receiving wireless signals; first and second flexible band portions (12, 14) connected at respective first ends to opposing edges of said housing; at least one antenna coupled to said wireless communication circuit; a connection device (16) for connecting second ends of said first and second band portions (12, 14) together to form a flexible band configured to attach the device to a user; at least one magnet (22) positioned in said first band portion (12); and a magnetic field sensor positioned in said second band portion, wherein said magnetic field sensor (20) is arranged to detect said at least one magnet (22) when said band portions (12, 14) are connected together.

3 Claims, 5 Drawing Sheets

(58) Field of Classification Search
USPC ..... 340/539.13
See application file for complete search history.

(56) References Cited

U.S. PATENT DOCUMENTS

| | | | | |
|---|---|---|---|---|
| 8,937,554 | B2 * | 1/2015 | Kwan | G08B 25/016 340/686.6 |
| 9,002,372 | B2 * | 4/2015 | Shakespeare | G01S 5/0027 340/539.13 |
| 2008/0055154 | A1 * | 3/2008 | Martucci | G01S 5/0027 342/357.55 |
| 2013/0237182 | A1 * | 9/2013 | Schlager | G08B 21/023 455/404.2 |

* cited by examiner

MONITORING DEVICE

FIELD OF THE INVENTION

This invention relates generally to a monitoring device and, more particularly, to a portable monitoring device that is configured to be worn by a monitored person and designed for remote, two-way communication with a user application to report at least location data in respect of the monitored person.

BACKGROUND OF THE INVENTION

Wearable monitoring devices are known. For example, International Patent Application No. PCT/US2013/020326 describes a wearable monitoring unit comprising a wireless electronic device and a band comprised of first and second band portions mounted on opposing sides of the electronic device. The electronic device includes a housing containing the required wireless communication circuitry, and the band is configured to enable a user to wear the unit on their wrist, for example. An RF antenna is connected to the communication circuitry and comprises a number of flexible conductive feeds that extend into the first band portion. The proposed device, in accordance with a described embodiment, is considered to be particularly suitable for monitoring the location of a child. The unit is monitored by a monitoring server and/or a parent/guardian to track the location of the monitored child, and also provides a function to allow the monitored child to remotely communicate with the parent/guardian.

SUMMARY OF THE INVENTION

The band in the above-described arrangement can be attached around a monitored child's limb (e.g. wrist), for example, by inserting a pair of peg-like fasteners on the first band portion into a pair of cooperative apertures on the second band portion, and several pairs of apertures may be provided for this purpose along the length of the second band portion to enable the size of the band to be adjusted according to the diameter of the monitored child's limb.

However, a problem arises with this type of arrangement in that, if the band breaks, is intentionally removed from, or falls off, the monitored child's limb, it may be some considerable time before either the monitored child or the parent/guardian becomes aware of this, during which time the monitored child's true location may be unknown, which is clearly undesirable.

Thus, a first aspect of the present invention seeks to address this issue, and provides a wireless monitoring device, comprising: a housing in which is contained a wireless communication circuit for sending and receiving wireless signals; first and second flexible band portions connected at respective first ends to opposing edges of said housing; at least one antenna coupled to said wireless communication circuit; a connection device for connecting second ends of said first and second band portions together to form a flexible band configured to attach the device to a user; at least one magnet positioned in said first band portion; and a magnetic field sensor positioned in said second band portion, wherein said magnetic field sensor is arranged to detect said at least one magnet when said band portions are connected together.

Optionally, said at least one antenna may be positioned in at least one of said first and second band portions, and connected to said wireless communication circuit. In one exemplary embodiment, an elongate magnetic strip may be positioned in the first band portion, which extends along at least a portion of its length from a position close to its second end. This is advantageous, as it allows the band size to be infinitely adjusted, according to the size of, for example, a user's wrist, without loss of magnetic proximity. In an alternative exemplary embodiment, a row or array of individual magnets may be positioned along at least a portion of the length of the first band portion.

The connection device may comprise a loop or ring on said second band portion, wherein the first band portion is configured to be threaded through the loop or ring in order to connect the second ends of the first and second band portions together. At least one, and possible both, of the opposing longitudinal side edges of the first band portion may be serrated, in order to provide a frictional connection between the first band portion and the loop or ring. In one exemplary embodiment, an opening may be provided near the distal end of the second band portion and configured to allow the distal end of the first band portion to be threaded therethrough before being inserted through the loop or ring in order to connect the first and second band portions together.

The magnetic proximity sensor may be configured to transmit a signal to the wireless communication circuit in the event that magnetic proximity with the at least one magnet is lost. However, in an alternative exemplary embodiment, the magnetic proximity sensor may be configured to transmit a continuous or intermittent signal to the wireless communication circuit whilst magnetic proximity is detected and cease transmission of said signal in the event that magnetic proximity is lost. In either case, the wireless communication circuit may be configured to transmit an alert signal to a remote location in the event that magnetic proximity is determined to have been lost.

In the monitoring device of PCT/2013/020326, a global positioning system (GPS) component may be provided, which is configured to receive coordinate information from various sources (e.g. satellites, base stations, etc) to determine a geographic position of the monitored child. However, a problem that arises with systems employing GPS components is that of impaired battery life. Clearly, in critical applications of this type, it is imperative that battery life between charging periods is conserved and maximised so as to minimise the risk of failure during monitoring periods. On the other hand, conventional GPS systems, which continuously search for location data, even when a source is not available, are known to severely impair battery life.

Thus, another aspect of the present invention seeks to address this issue, and provides a wireless monitoring device, comprising a housing in which is contained a wireless communication circuit for sending and receiving wireless signals; a flexible band configured to attach the device to a user; and an antenna coupled to said wireless communication circuit; wherein said wireless communication circuit is configured to: normally operate in a low-power hibernation mode and, periodically and/or in response to a manual location request signal received from a remote location, operate in an active mode in which it searches for a location data source, wirelessly transmits location data to a remote location if a location data source is identified, and wirelessly transmits an alert signal to a remote location if a location data source is not found, before returning to said low-power hibernation mode.

Optionally, said antenna may be positioned in said flexible band and connected to said wireless communication circuit. In one exemplary embodiment, in said low-power hibernation mode, said wireless communication circuit and said antenna may be substantially inoperative, and operative only to receive a manual location request signal.

It is envisaged that the wireless communication circuit may be configured to sequentially search for one of a number of location data sources, including GPS satellite signals and/or mapped wi-fi or mobile network base stations, for example. However, such location data sources may also comprise bespoke sources provided in and around specific locations, such as a shopping centre or theme park for example.

In one exemplary embodiment of the present invention, the wireless communication device includes a SIM card, and a GSM interface which enables very quick pairing of a unit with the monitoring user application by automatically transmitting a first SMS message from the unit to the user application and receiving a responding SMS message from the user application, thus generating pairing data and rendering the unit ready for use.

BRIEF DESCRIPTION OF THE DRAWING FIGURES

These and other aspects of the present invention will be apparent from the following specific description in which embodiments of the present invention are described by way of examples only and with reference to the accompanying drawings, in which.

Figure 3A:
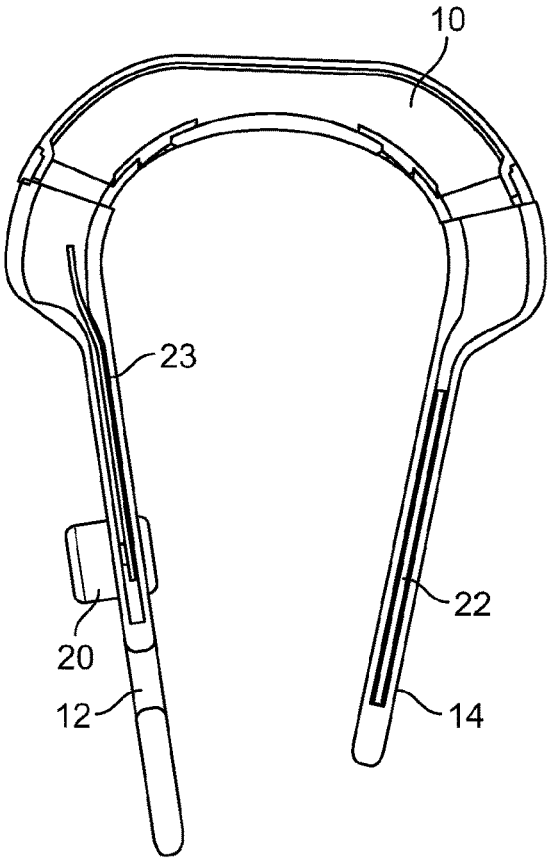
Figure 3B:
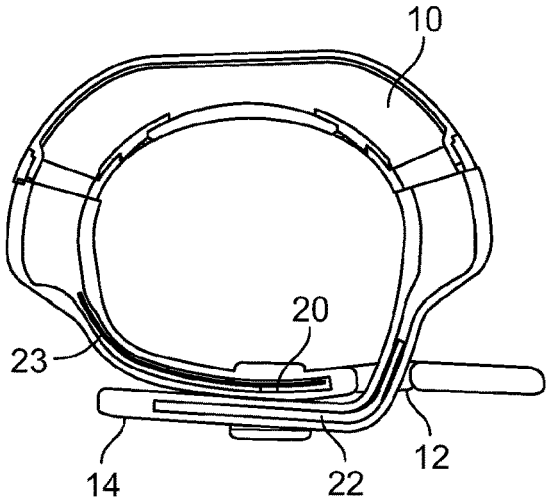
Figure 4:
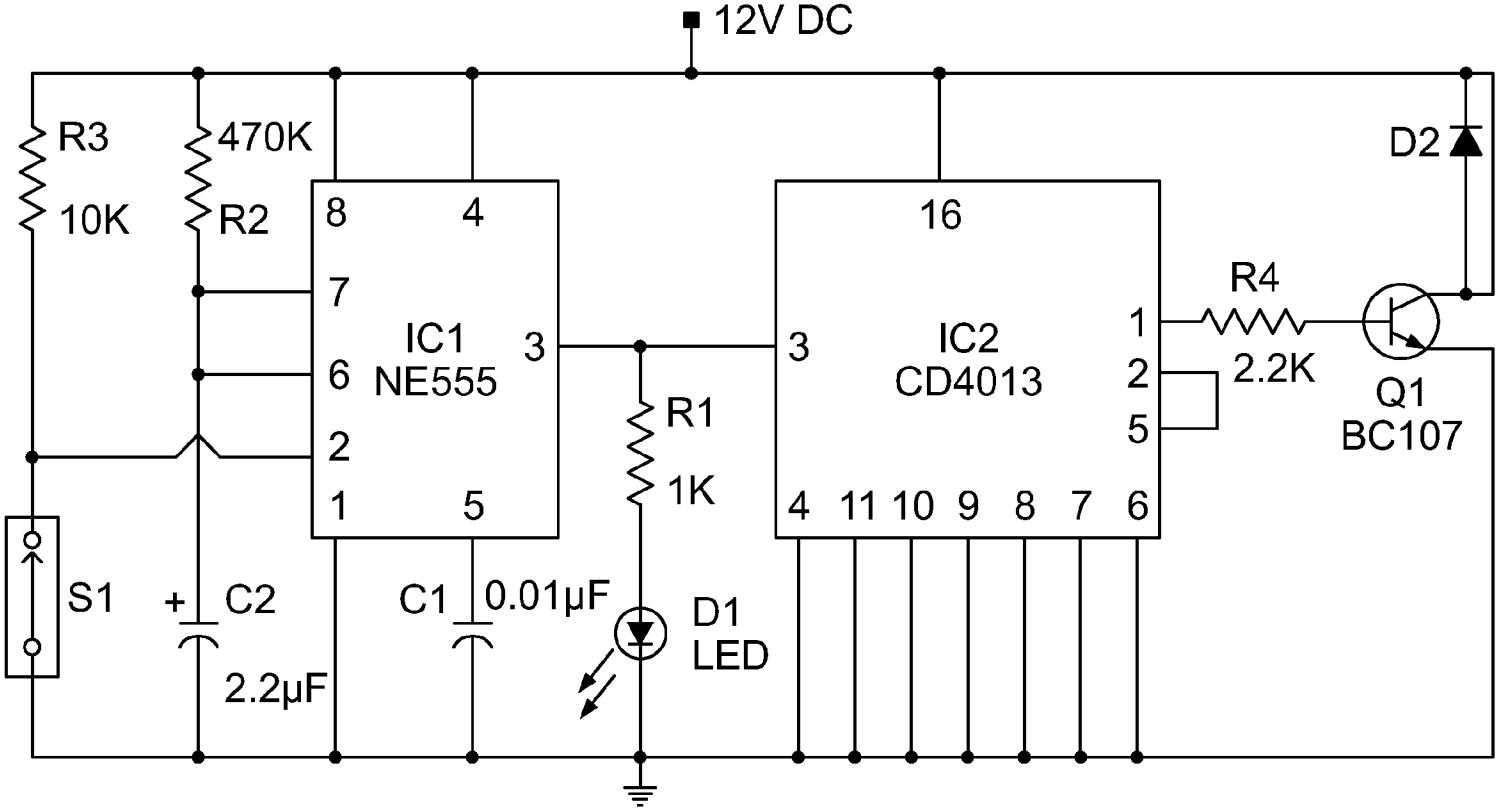
Figure 5:
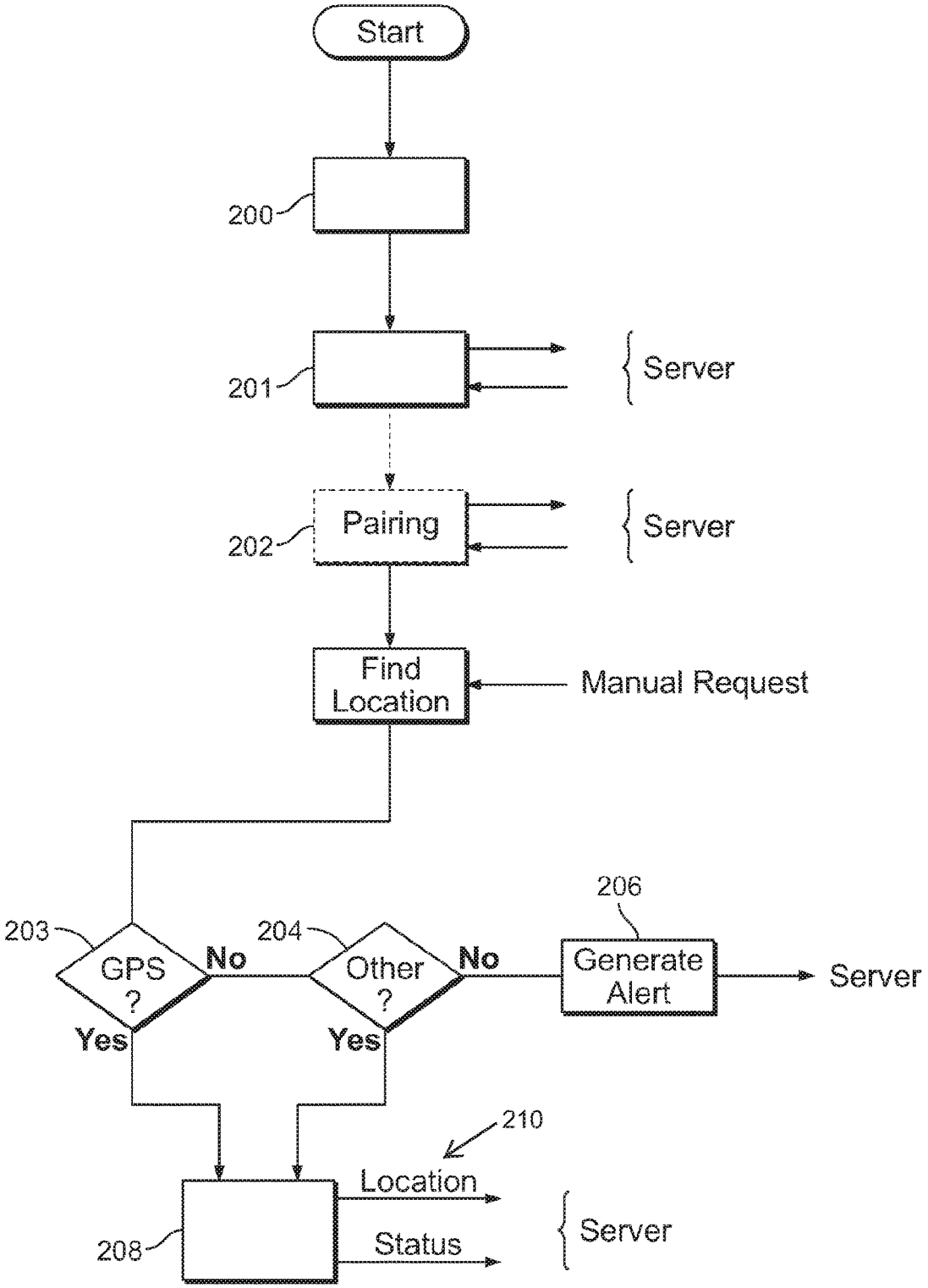

FIGS. 3*a* and 3*b* are schematic cross-sectional views of a monitoring device according to an exemplary embodiment of the present invention, in the open and closed configurations respectively; and FIG. 4 is a circuit diagram illustrating a magnetic proximity switch for use in a monitoring device according to an exemplary embodiment of the present invention; and FIG. 5 is a schematic flow diagram illustrating some of the principal steps in a location detection and reporting method for use in an exemplary embodiment of the present invention.

DETAILED DESCRIPTION OF THE INVENTION

Figure 1:
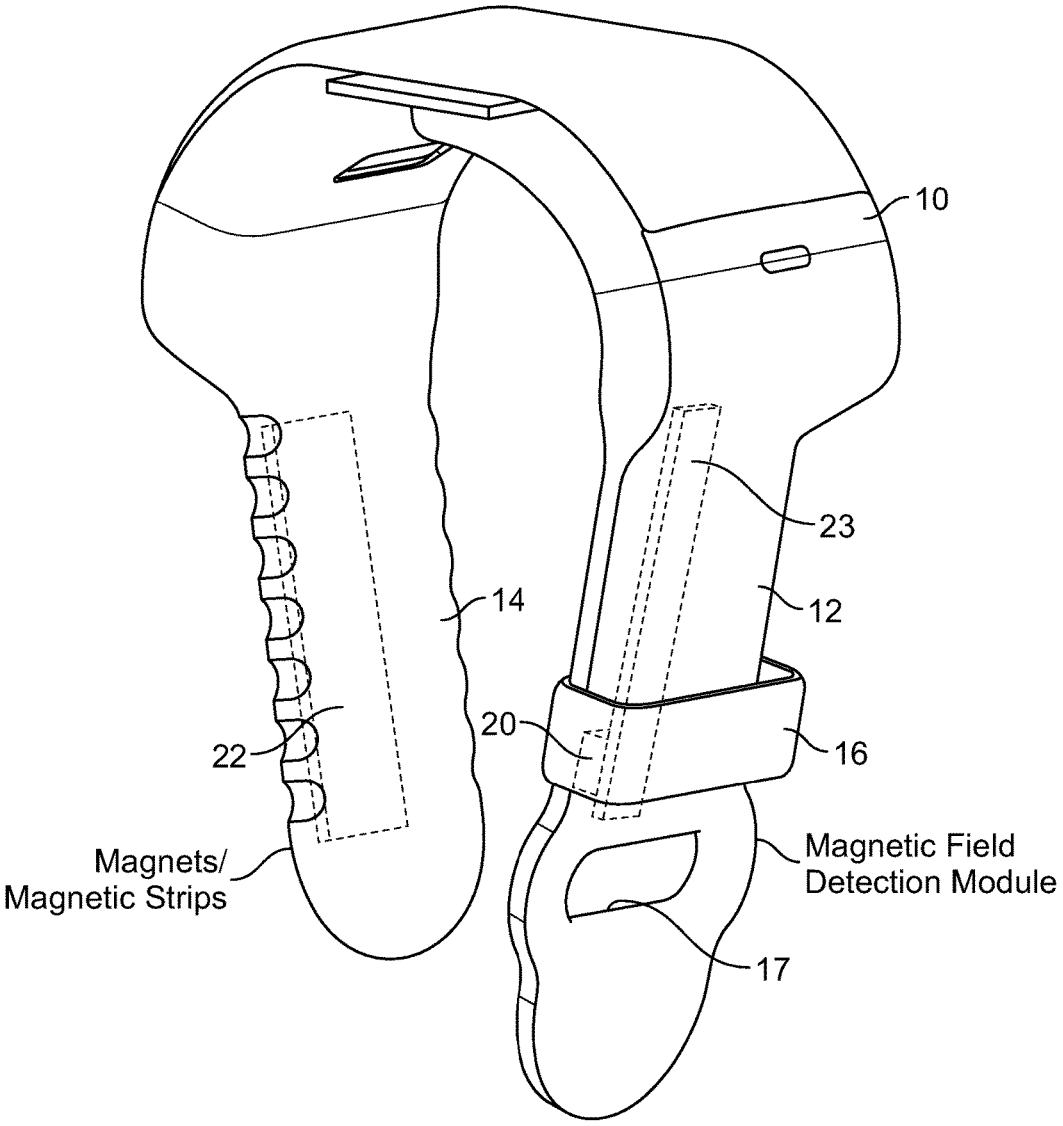
FIG. 1 is a schematic perspective view of a monitoring device according to an exemplary embodiment of the present invention.

Referring to FIG. 1 of the drawings, a monitoring device according to an exemplary embodiment of the present invention comprises a housing 10, within which is contained the device circuitry, and first and second flexible band portions 12, 14 affixed to opposing side edges of the housing 10. Elongate, flexible antenna feeds (not shown) may be embedded in one or other of the band portions 12, 14, extending from the device circuitry, as will be familiar to a person skilled in the art. Alternatively, one or more antennas may be provided within the device circuitry itself. The band portions may be formed of any flexible material, which is preferably malleable to some extent, such as rubber or the like. A fastening loop 16 is provided on the first band portion 12 and opposing longitudinal side edges of the second band portion 14 may be serrated, as shown. The distal end of the second band portion 14 may be rounded or narrowed to a point. The distal end of the first band portion 12 may also be rounded or narrowed to a point, and is provided with an opening 17.

Referring additionally to FIGS. 3*a* and 3*b* of the drawings, in use, to fasten the device to user's wrist, for example, the housing is placed on the upper surface of the wrist and the first and second band portions 12, 14 are wrapped around the user's wrist. In order to fasten the two band portions 12, 14 together, the rounded or pointed distal end of the second band portion 14 is fed through the opening 17 and then through the fastening loop 16, and pulled through until the inner diameter of the band substantially comfortably matches that of the user's wrist. As the second band portion 14 is pulled through the loop 16, the serrated edges engage with the edges of the opening 17 and the loop 16 such that, when the desired diameter is reached, the band is held in the desired configuration by friction therebetween.

An array of magnets or a magnetic strip 22 is embedded within the first band portion 12 and a magnetic field detection module including, for example, a magnetic proximity switch 20 is embedded adjacent the distal end of the second band portion 14. When the band portions are correctly secured together, the magnetic proximity switch is active and transmits a signal, via a flexible conductor 23 embedded in the first band portion 12, to the electronic circuitry held within the housing 10. In the event that the proximity switch signal stops, thus indicating that the band portions are no longer correctly secured together, the circuitry is configured to detect this and generate an alert. In one exemplary embodiment, such an alert may comprise the generation and transmission of an SMS message to the user application of the monitoring person.

As stated above, a magnetic proximity switch 20 is provided in a first band portion 12 of the monitoring device, and a circuit diagram of a typical magnetic proximity switch is illustrated in FIG. 4 of the drawings. As shown, an exemplary circuit of this type is based on a magnetic reed switch S1 as the proximity sensor. A monostable multivibrator IC1 and a toggle flip flop IC2 form the basis of the rest of the circuit. When a magnet is in proximity of S1, it closes to give a negative trigger at pin2 of IC1. The output of IC1 goes high for a time determined by R2 and C2. This clocks the IC2, wired as a toggle flip flop. The output (pin 1) of IC2 goes high and the transistor Q1 is biased to ON, thereby causing a signal to be transmitted to the device circuitry within the housing 10 of the monitoring device. An LED D1 may also be provided, which glows when IC1 is triggered, and provides a visual indicator that the two band portions 12, 14 are correctly fastened together. It will be appreciated by a person skilled in the art that other types of magnetic field sensing may be used for this purpose, such as arrangements including one or more Hall sensors or AMR/GMR MEMS sensors, for example, and the present invention is not necessarily intended to be limited in this regard.

Figure 2:
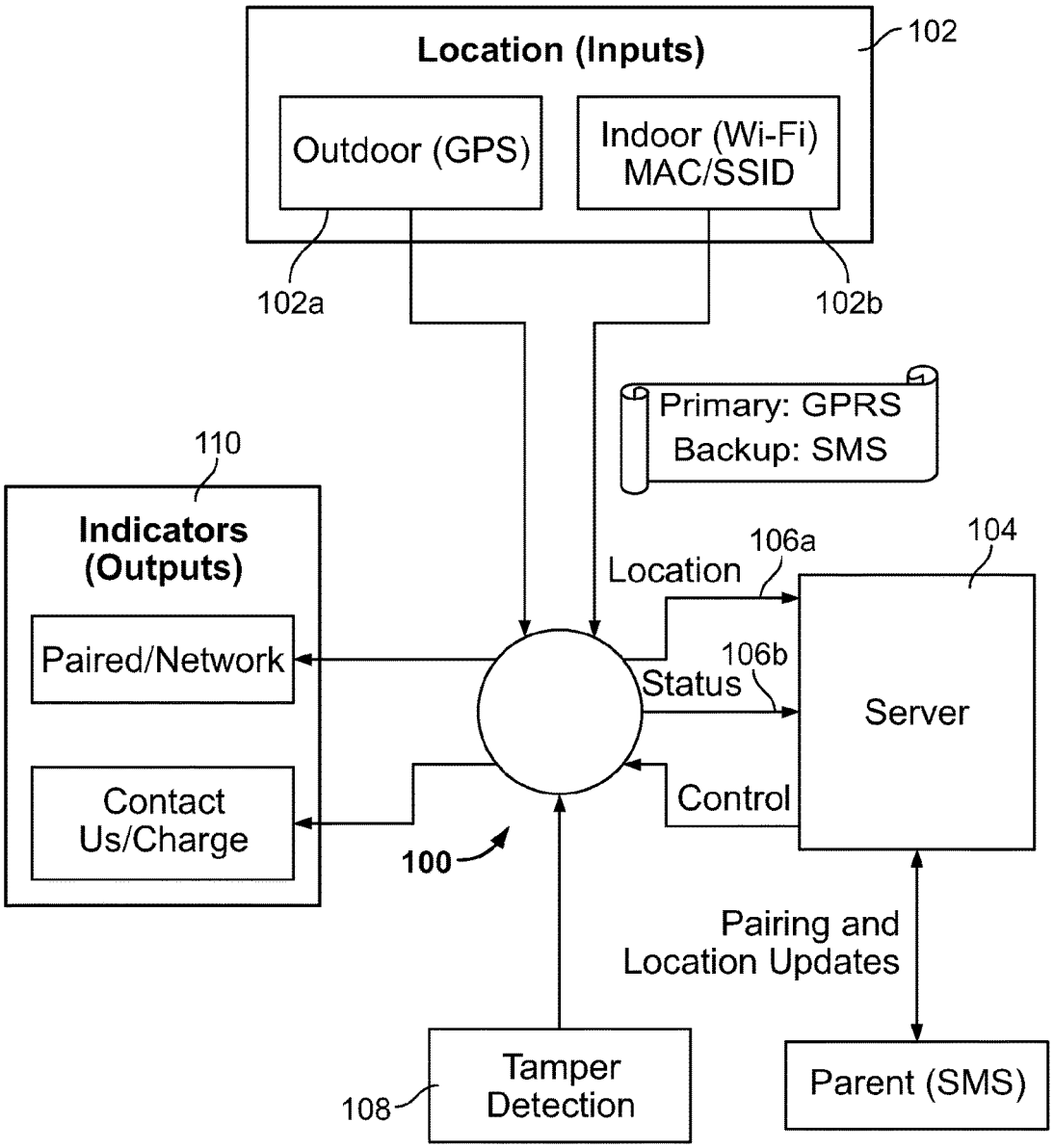
FIG. 2 is a schematic block diagram illustrating principal components of a monitoring device according to an exemplary embodiment of the present invention.

Referring to FIG. 2 of the drawings, a monitoring system, including a monitoring device 100 according to an exemplary embodiment of the invention is illustrated schematically in the form of a block diagram. It can be seen that the system has a number of location data inputs 102. In the example shown, such inputs may comprise GPS satellite signals 102*a* for use outdoors, and Wi-fi or mobile network base station signals 102*b* for indoor use. It is known, in recent years, for Wi-fi and mobile network base stations to be geographically mapped. Thus, if the device can connect to such a mapped base station, then its absolute geographical location can be transmitted to the device in the form of location data. The device 100 is configured to transmit at least two types of output data to a remote server 104, namely location data 106*a* and status data 106*b*. The server 104 is configured to transmit location and/or status data relating to a paired device to a remote application provided on, for example, a parent's mobile computing device. Such data may be transmitted by, for example, an SMS message. Location data may be displayed on the parent's computing screen in the form of a map illustrating the precise geographical location of their child's device.

The device 100 further receives signals from the above-mentioned magnetic proximity sensor, which function is illustrated in FIG. 4 as a tamper detection module 108. The device 100 may provide at least two visual indicators 110, in the form of, for example, coloured LEDs. Such indicators may be a) whether or not the device is paired to the server and/or connected to a network capable of providing location data, and b) that the parent wants the child to contact them and/or that the device battery requires charging. In any event, the visual indicators are, at least in some exemplary embodiments of the invention, intended to provide a simple form of indicator for children. As an example, a rapid red flashing light may be provided to indicate to a child that they are required to return immediately to a pre-agreed safety point or make contact with their parent/guardian (possibly in response to a request signal transmitted from the parent's mobile application, via the server, to the device), an intermittent red flashing light may be provided to indicate to a child that they are required to make their way back to an agreed location, either for battery recharging or to return to GSM coverage, for example, and an intermittent green light may be an indication that all is well.

Referring to FIG. 5 of the drawings, in use, the system of FIG. 2 may be configured to operate as follows:

Step 200: The monitoring device is affixed to a monitored person's wrist, by means of the process described above, so that it is securely fastened and the magnetic strip is in proximity of the magnetic proximity sensor.

Step 201: The circuitry within the device receives a signal from the magnetic proximity sensor and transmits an actuation signal to the server; and the server returns an acknowledgement signal.

Step 202: if the monitoring device and the parent's mobile application are not already paired, the device transmits an SMS message to the parent's mobile telephone number, in response to which the mobile application transmits an SMS message back from the parent's mobile telephone to the monitoring device, in response to receipt of which, the device and the application are paired.

Step 203: The device circuitry is configured to first look for a GPS satellite signal. If this is found, location data therefrom is received and location data is transmitted to the server.

Step 204, if no GPS signal is found, the device circuitry looks for a mapped Wi-fi or mobile telephone base station. If this is found, location data therefrom is received and location data is transmitted to the server.

Step 206: if no location data can be obtained, the device is configured to transmit an alert signal to the server which, in turn, causes an alert message, possibly in the form of an SMS message, to be transmitted to the parent's mobile application to alert them that no location data can be obtained at that time. The device does not continuously "look" for location data: it periodically looks for the GPS signal and then the base station signal and, if neither is found, an SMS message is sent to the parent's mobile application, via the server, before the device returns to its low power hibernating mode, in which it is only "listening" for a manual location request. In this manner, and in contrast to know location finding devices, the battery power can be optimised.

Step 208: If location data is received from the device by the server, the server transmits such location data to the paired mobile application. This may be done periodically, and/or at the request of the parent's mobile application. In one exemplary embodiment, and in order to save power wherever possible, the device may be configured to automatically obtain and send location data every, say, 15 minutes (unless a specific request for location data is received, via the server, from the parent's mobile application), such that, for the majority of time, the device and antenna is in a low power hibernating state, in which it is only "listening" for a manual location request. Such location data is transmitted by the server to the parent's mobile application, where it may be displayed as, for example, a marker on a map.

Step 210: Concurrently to the location data, the device is configured to transmit status data to the server. Status data indicates the status of the device. Thus, it may indicate that the status of the device is operative and location data is available. It may also indicate that the device is no longer securely attached to the child, as the magnetic proximity sensor is no longer transmitting a signal. It may also indicate that no location data is available, or that the device battery has failed. The server may be configured to transmit corresponding status data to the paired mobile application, possibly in the form of an informative SMS message or the like.

A charger (not shown) may be provided for receiving and pairing the device contacts with a battery charging facility. In some circumstances, it may be desirable to unpair devices from respective mobile applications after use, and the charger may, therefore, be configured to send a message to the server accordingly when the battery reaches a certain level of charge, for example.

It will be apparent to a person skilled in the art, from the foregoing description, that modifications and variations can be made to the described embodiments without departing from the scope of the invention, as claimed.

The invention claimed is:

1. A wireless monitoring device, comprising a housing in which is contained a wireless communication circuit for sending and receiving wireless signals; a flexible band configured to attach the device to a user; and an antenna coupled to said wireless communication circuit; wherein said wireless communication circuit is configured to: normally operate in a low-power hibernation mode and, periodically and/or in response to a manual location request signal received from a remote location, operate in an active mode in which it searches for a location data source, wirelessly transmits location data to a remote location if a location data source is identified, and wirelessly transmits an alert signal to a remote location if a location data source is not found, before returning to said low-power hibernation mode.

2. The device according to claim 1, wherein said antenna is positioned in said flexible band and connected to said wireless communications circuit.

3. The device according to claim 1, wherein in said low-power hibernation mode, said wireless communication circuit and said antenna are substantially inoperative, and operative only to receive a manual location request signal.

* * * * *